US005477996A

United States Patent [19]

Migliorini

[11] Patent Number: 5,477,996

[45] Date of Patent: Dec. 26, 1995

[54] METHOD AND APPARATUS FOR AUTOMATICALLY POSITIONING STOCKINGS IN A PANTYHOSE-FORMING MACHINE

[75] Inventor: Pier L. Migliorini, Terranuova Bracciolini, Italy

[73] Assignee: Solis s.r.l., Impruneta, Italy

[21] Appl. No.: 274,093

[22] Filed: Jul. 12, 1994

[30] Foreign Application Priority Data

Jul. 29, 1993 [IT] Italy ..... FI93A 149

[51] Int. Cl.[6] ..... A47G 25/90; D06C 5/00

[52] U.S. Cl. ..... 223/112; 223/75

[58] Field of Search ..... 223/75, 76, 77, 223/112, 111; 38/102.91; 112/121.15

[56] References Cited

U.S. PATENT DOCUMENTS

| | | | |
|---|---|---|---|
| 2,154,369 | 4/1939 | Wanamaker | 223/75 |
| 4,515,299 | 5/1985 | Sewell et al. | 223/112 |
| 4,541,351 | 9/1985 | Horita . | |
| 5,316,188 | 5/1994 | Froehlich et al. | 223/75 |

FOREIGN PATENT DOCUMENTS

| | | | |
|---|---|---|---|
| 1352234 | 1/1964 | France | 223/112 |
| 6091060 | 7/1981 | Japan | 223/75 |
| 2081321 | 2/1982 | United Kingdom | 223/75 |
| 2239877 | 7/1991 | United Kingdom | 223/75 |

*Primary Examiner*—C. D. Crowder
*Assistant Examiner*—Bibhu Mohanty
*Attorney, Agent, or Firm*—McGlew and Tuttle

[57] ABSTRACT

Apparatus for positioning two stockings in a machine for making pantyhose articles and comprising a pair of horizontal flat shapes (5) which support the stockings (5), the apparatus being made up of: —gripper elements (1) for withdrawing a limited side portion of the fabric of each stocking (4) fitted on the respective support shape (5), and this in correspondence of the two side edges of the shape (5); —elements for supporting said gripping elements (1) and moving them in a direction orthogonal to the longitudinal axis (8) of the shape (5), from a retracted position, where their travel begins, to an advanced position, where the same travel ends in correspondence of said shape, and vice versa, with a pneumatic cylinder (2) having horizontal axis orthogonal to the axis (8) of the shape (5); —cam means for activating the withdrawal and respectively release of the stocking (4) by the said gripping elements (1); —and an optical sensor connected to each cylinder (3) to activate and deactivate the gripper upon alignment of the garter line.

8 Claims, 3 Drawing Sheets

METHOD AND APPARATUS FOR AUTOMATICALLY POSITIONING STOCKINGS IN A PANTYHOSE-FORMING MACHINE

FIELD OF THE INVENTION

The present invention refers to a method and apparatus for the automatic positioning of stockings in a pantyhose-forming machine, with automatic detection of the garter line.

BACKROUND OF THE INVENTION

It is known that in order to produce a pantyhose article, two stockings must be first individually fitted on a pair of flat, superimposed shapes and then vertically aligned close to each other so as to provide a correspondence between the elastic hems of the bodices of the two stockings and the respective garter lines which form the line of demarcation between two stocking regions exhibiting fabric of different consistency, such as the bodice and the leg of each stocking. Afterwards, the two thus positioned stockings must be longitudinally cut starting from the elastic hem of the bodice up to a predetermined distance from the garter line. Subsequently, the juxtaposed edges of the two thus cut stockings must be sewn together to form the pantyhose article: the sewing being carried out over the whole length of the edges.

Consequently, in order to carry out, with the necessary accuracy, the cut and the subsequent sewing for the union of the two stockings, it is necessary that each stocking be properly positioned on the respective support shape to provide the exact vertical alignment between the elastic hems and the garter lines of the two stockings, and that the same garter lines be clearly detected.

To allow for the automatic detection of the garter line of the stockings, apparatuses are known comprising optical sensors responsive to the difference of consistency between the fabric of the bodice and that of the leg of the stockings. But, for the optical detection of said sensors to be correctly and precisely operated it is necessary that the stockings be disposed in stretched condition, that is, wrinkle-free, so as to avoid wrong detections due, for example, to the superimposition of two portions of fabric having the same consistency.

The technical solutions so far known for disposing in a predetermined position the two stockings to be seamed to form a pantyhose article, have substantially the same root. The two stockings are fitted at random on the respective support shapes; then, the optical sensors, movable longitudinally to the shapes, detect the position of the elastic hems of the bodices to operate—through a horizontal translation thereof towards the end of the shapes opposite to their tip—the activation of the first gripping means able to pick up said elastic hems and draw them up to a predetermined position of mutual vertical alignment; afterwards, with the aid of second gripper or track means which act upon the side portion of the stockings fitted on the shapes and are driven by second optical sensors, the stockings are moved towards the tip of the shapes until the portion of each stocking, lying between the elastic hem of the bodice and the garter line, results disposed in stretched condition and there is obtained the vertical alignment of the two garter lines. All this being described also in the U.S. document 4,541,351.

However, the implementation of this operating method brings about several drawbacks. The major of said drawbacks consists in the need of moving the elastic hem and the leg of each stocking in two distinct steps and by means of different positioning members which operate separately. This implies a more complex construction of the devices provided for this operation, with increased cost for the fabrication and running thereof.

SUMMARY AND OBJECTS OF THE INVENTION

The main object of the present invention is to propose a method and apparatus for positioning two stockings to be united to form a pantyhose article, which allow a significant reduction of the cost for producing the pantyhose-forming machines and of the time for positioning the stockings while ensuring at the same time a remarkable operation reliability.

This result has been achieved, according to the invention, by adopting an operating method comprising an initial step in which each stocking is randomly loaded on a corresponding support shape, as well as the following operating steps:

withdrawing and retaining a limited side portion of the fabric of each stocking;

drawing back, that is pulling, one or more times, said thus retained portion of fabric, in a transverse or oblique and centrifugal direction with respect to the longitudinal axis of the corresponding shape, to such an extent as to allow the draw of the fabric-forming stitches and the subsequent return, in the direction of the longitudinal axis of the shape, of the stocking portion which includes the garter line, until the latter results in the predetermined position with respect to the corresponding shape;

releasing the stocking with the garter line thus positioned.

And as far as the apparatus for implementing said method and comprising two horizontal flat paired shapes is concerned, it is made up of:

gripping means for withdrawing a limited side portion of a stocking fitted on the corresponding support shape, and this in correspondence of a side edge of the shape;

pneumatically operated means for supporting and driving said gripping means in an orthogonal or oblique and centrifugal direction with respect to the longitudinal axis of the shape, from a retracted position where their travel begins to an advanced position where the same travel ends in correspondence of said shape and vice versa;

cam means for activating the withdrawal and respectively release of the stocking by said gripping means;

at least an optical sensor, for each shape, which is disposed in correspondence of a predetermined position of alignment of the garter lines of the two stockings, and is associated to the gripper acting on the corresponding shape, to cause the deactivation of same gripper upon completion of said alignment.

The advantages deriving from the present invention consist essentially in that it is possible to operate the correct alignment of the garter lines of the two stockings to be united to form a pantyhose article in a simple, fast and precise way; that an apparatus according to the invention is simple to build, economical and reliable even after a long service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
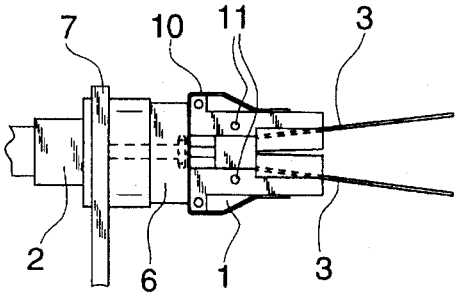
FIG. 1A schematic view of an apparatus according to the invention, in rest condition.
Figure 1B:
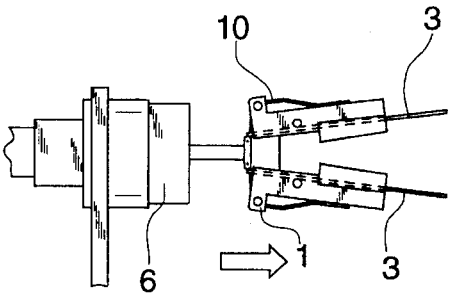
FIG. 1B shows the apparatus of FIG. 1A upon the stage in which the gripper is made to advance wide open to grip a stocking.
Figure 1C:
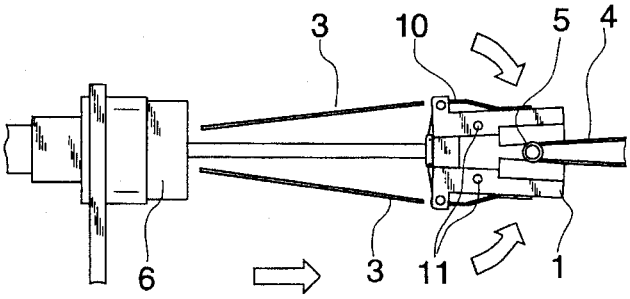
FIG. 1C shows the apparatus of FIG. 1A upon the stage of withdrawing a side portion of the stocking.
Figure 1D:
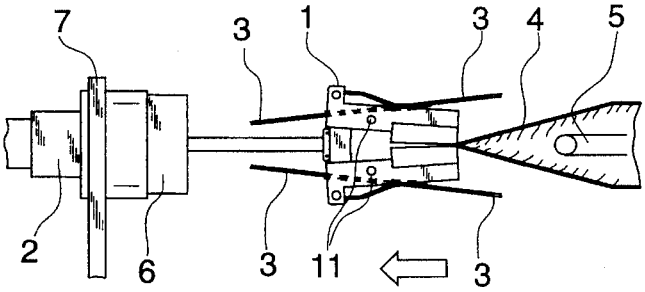
FIG. 1D shows the apparatus of FIG. 1A upon the stage in which the stocking is moved back and stretched.
Figure 1E:
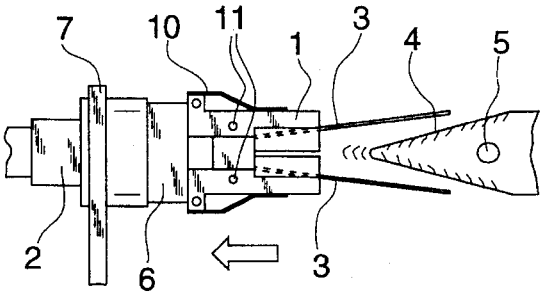
FIG. 1E shows the apparatus of FIG. 1D in a position where the gripper has released the stocking at the end of its travel.
Figure 2A:
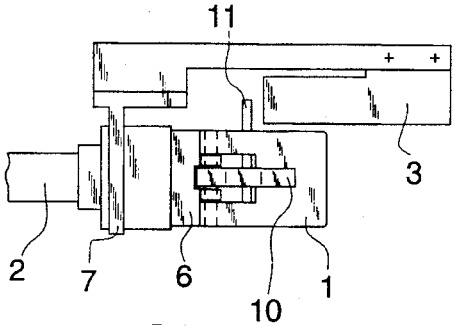
FIG. 2A is a plan view of the apparatus of FIG. A.
Figure 2B:
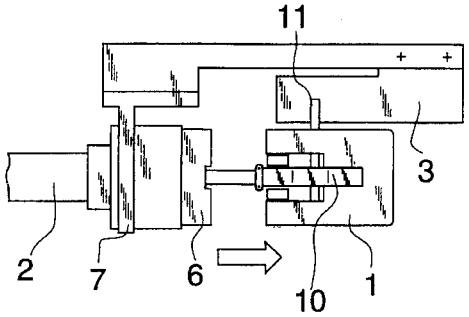
FIG. 2B is a plan view of the apparatus of FIG. 2B.
Figure 2C:
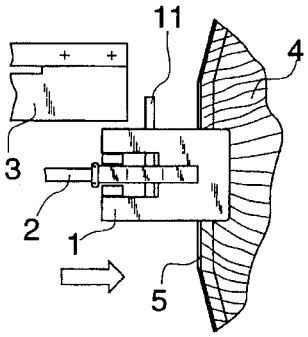
FIG. 2C is a plan view of the apparatus of FIG. 1C.
Figure 2D:
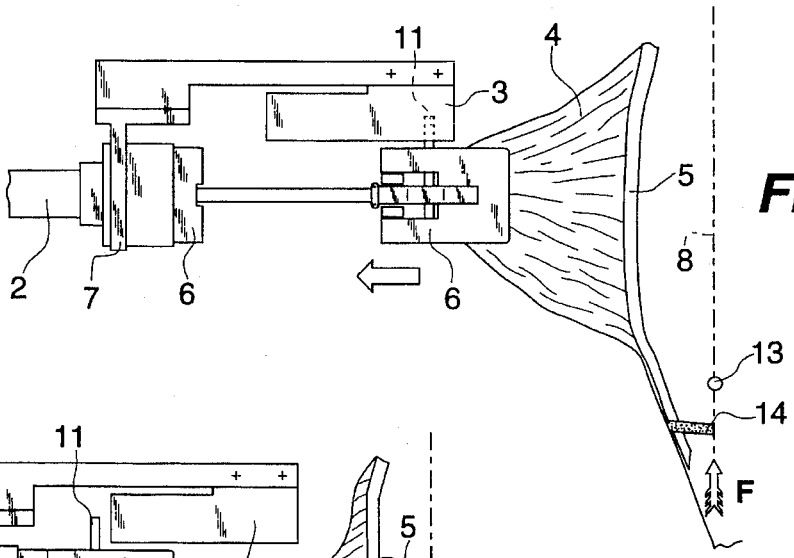
FIG. 2D is a plan view of the apparatus of FIG. 1D.
Figure 2E:
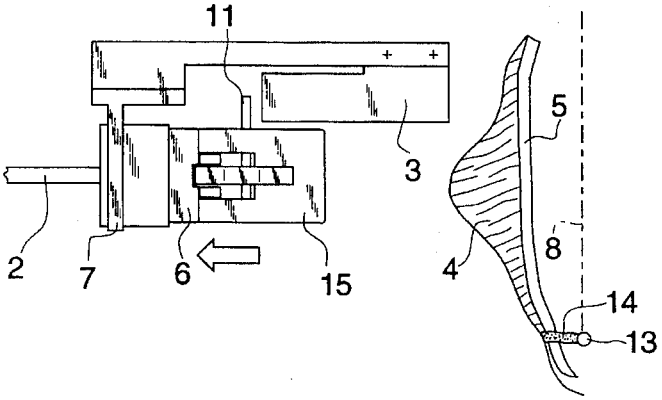
FIG. 2E a plan view of the apparatus of FIG. 1E.

Reduced to its basic structure, reference being made to FIGS. 1A–2E of the attached drawings, a method for disposing two stockings in the condition enabling the vertical alignment of the respective garter lines, in a pantyhose-forming machine, and comprising an initial step for fitting each stocking (4) at random on a corresponding support shape (5), according to the invention, includes:

withdrawing and retaining a limited side portion of the fabric of each stocking (4) in correspondence of the two side edges of the relevant shape (5);

drawing back, that is pulling, one or more times, said thus retained fabric portion of each stocking (4), in a transverse and perpendicular or radial direction with respect to the longitudinal axis (8) of the corresponding shape (5), to such an extent as to allow the draw of the fabric stitches and the subsequent return, in the direction (see arrow F in FIG. 2D) of the longitudinal axis (8) of the shape (5), of the stocking portion which includes the garter line (14), until the latter results in the predetermined position with respect to the corresponding shape (5); and finally, releasing each stocking (4) with the garter line (14) thus positioned.

And as far as the apparatus for implementing said method and comprising two pairs of horizontal and superimposed flat shapes (5) for the support of the two stockings is concerned, it is made up of:

gripping means (1) for withdrawing a limited side portion of each stocking (4) fitted on the corresponding support shape (5), and this in correspondence of the two side edges of the shape (5);

pneumatically operated means for supporting and moving said gripping means (1) in a direction orthogonal to the longitudinal axis (8) of the shape (5), from a retracted position where their travel begins to an advanced position where the same travel ends in correspondence of said shape and vice versa, with a pneumatic cylinder (2) whose horizontal axis is orthogonal to the axis (8) of the shape (5);

cam means (3) for activating the withdrawal and respectively release of the stocking (4) by said gripping means (1);

at least an optical sensor (13), for each shape (5), which is disposed in correspondence of a predetermined position of alignment of the garter lines of the two stockings (4), and is associated to the cylinder (2) which drives into motion the gripper (1) of the corresponding shape (4), to cause the deactivation of same gripper upon completion of said alignment.

Figure 3:
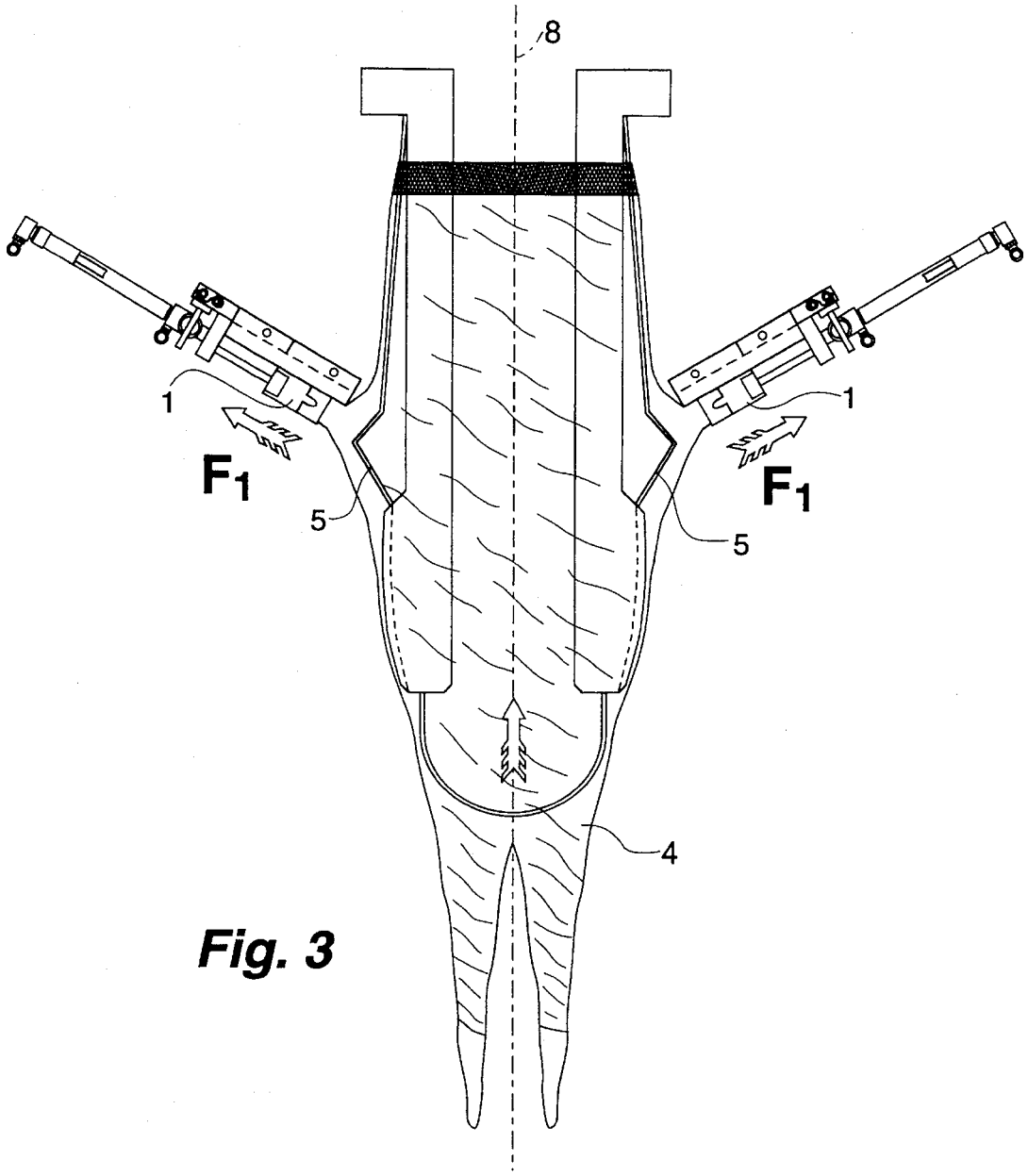
FIG. 3 a schematic plan view of an alternative embodiment of the apparatus according to the invention.

Alternatively, reference being made to FIG. 3 of the attached drawings, said gripping means (1) are driven into an alternate translation in oblique direction (F1) with respect to the longitudinal axis (8) of the corresponding shape (5).

Advantageously, according to the invention, said gripper (1) is of a type having flat, normally closed fingers (15).

Moreover, according to the invention, a stop or abutment element (6) is advantageously interposed between the head of the gripper (1) and the relevant driving cylinder (2), so as to limit the operative return travel of the gripper (1) and exert a push on the back side of each finger (15) for producing a moment for the opening of the same gripper (1) and causing the release of the stocking (4).

According to the invention, an elastic lamina (10) is fitted longitudinally astride on the two fingers (15) of said gripper (1) so as to allow the spontaneous closing of the latter in resting condition.

Advantageously, said cam (3) has a dual straight profile diverging symmetrically towards the support shape (5) of the stocking (4) to operate the activation, that is, the opening and respectively the closing of the gripper (1), in cooperation with two pivots (11) each of which is idly fitted within a corresponding finger (15) of the gripper (1) so as to result laterally projecting therefrom and thus engaging a corresponding profile of the cam (3) during the motion of the gripper (1): said cam (3) being interposed between the cylinder (2) which drives the gripper (1) and the shape (5) which supports the stocking (4).

The continuous withdrawal and subsequent release of said side portions of each stocking (4) is cause for the stretching and lateral tension thereof and, consequently, for the return of the garter line (14) in the direction of the longitudinal axis (8) of the shape (5) towards the relevant gripper (1). This operation is repeated until the sensor (13) detects the presence of the garter line (14) of each stocking (4). At this point, the gripper (1) leaves the stocking (4).

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. Method for disposing two stockings having fabric stitches with their respective garter lines in vertical alignment in a machine for manufacturing pantyhose, with an initial step consisting in fitting each stocking at random on a corresponding support shape, comprising also the following operating steps:

withdrawing and retaining a limited side portion of the fabric of each stocking in correspondence with the two side edges of the relevant corresponding support shape;

drawing back at least once said thus retained fabric portion of each stocking in a transverse perpindicular direction with respect to the longitudinal axis of the corresponding shape to such an extent so as to allow the drawing back of the fabric stitches and the subsequent return in the direction of the longitudinal axis of the corresponding support shape of the stocking fabric portion which includes the garter line until the garter line is a predetermined position with respect to the corresponding support shape; and finally, releasing each stocking with the garter line in the predetermined position.

2. Method according to claim 1, wherein the withdrawal of the side portions of each stocking is carried out in an oblique direction (F1) to the axis of the relevant shape.

3. Apparatus for positioning two stockings on a machine for manufacturing pantyhose articles, having a pair of horizontally disposed flat corresponding support shapes which support the stockings, comprising:

gripping means for withdrawing a limited side portion of each stocking fitted on the corresponding support shape in correspondence of a side edge of the shape;

means for supporting and moving said gripping means in a direction orthogonal to the longitudinal axis of the shape, from a retracted position where their travel begins to an advanced position where the same travel ends in correspondence of said shape and vice versa, with a pneumatic cylinder whose horizontal axis is orthogonal to the axis of the shape;

cam means for activating the withdrawal and respectively releasing of the stocking by said gripping means;

at least an optical sensor, for each shape, which is disposed in correspondence of a predetermined position of alignment of the garter lines of the two stockings, and is associated to the cylinder which drives into motion the gripper of the corresponding shape to cause the deactivation of same gripper upon completion of said alignment.

4. Apparatus according to claim 3, wherein said gripping means are driven into an alternate translation in oblique direction (F1) with respect to the longitudinal axis of the corresponding shape.

5. Apparatus according to claim 4, wherein said gripping means has flat, normally closed fingers.

6. Apparatus according to claims 3 or 4, comprising also a stop or abutment element interposed between the head of the gripping means and the relevant driving cylinder, so as to limit the operative return travel of the gripping means and exert a push on the back side of a finger for producing a moment for the opening of the same gripping means and causing the release of the stocking.

7. Apparatus according to claim 3, comprising also an elastic lamina which is fitted longitudinally astride on two fingers of said gripping means so as to allow the spontaneous closing of the latter in resting condition.

8. Apparatus according to claim 3, wherein said cam has a dual straight profile diverging symmetrically towards the support shape of the stocking to operate the activation, that is, the opening and respectively the closing of the gripping means, in cooperation with two pivots each of which is fitted within a corresponding finger of the gripping means so as to result laterally projecting therefrom and thus engaging a corresponding profile of the cam during the motion of the gripping means; said cam being interposed between the cylinder which drives the gripping means and the shape which supports the stocking.

* * * * *

UNITED STATES PATENT AND TRADEMARK OFFICE

CERTIFICATE OF CORRECTION

PATENT NO. : 5,477,996
DATED :December 26, 1995
INVENTOR(S) :Pier Lorenzo Migliorini It is certified that error appears in the above-indentified patent and that said Letters Patent is hereby corrected as shown below:

On the title page: Item [75] Inventor's name should read -- Pier Lorenzo Migliorini --.

Signed and Sealed this

Twenty-eighth Day of May, 1996

*Attest:*

*Attesting Officer*

BRUCE LEHMAN

*Commissioner of Patents and Trademarks*